US010965002B2

(12) United States Patent
Gothelf et al.

(10) Patent No.: US 10,965,002 B2
(45) Date of Patent: Mar. 30, 2021

(54) ANTENNA AND A METHOD OF OPERATING IT

(71) Applicant: THRANE & THRANE A/S, Kgs. Lyngby (DK)

(72) Inventors: Ulrich Vesterager Gothelf, Maaloev (DK); Kim Woelders, Farum (DK)

(73) Assignee: THRANE & THRANE A/S, Lyngby (DK)

( * ) Notice: Subject to any disclaimer, the term of this patent is extended or adjusted under 35 U.S.C. 154(b) by 175 days.

(21) Appl. No.: 16/310,931

(22) PCT Filed: Jun. 21, 2016

(86) PCT No.: PCT/EP2016/064298

§ 371 (c)(1),
(2) Date: Dec. 18, 2018

(87) PCT Pub. No.: WO2017/220129

PCT Pub. Date: Dec. 28, 2017

(65) Prior Publication Data

US 2020/0321680 A1 Oct. 8, 2020

(51) Int. Cl.
*H01Q 1/12* (2006.01)
*H01Q 3/08* (2006.01)

(52) U.S. Cl.
CPC ..... *H01Q 1/1264* (2013.01); *H01Q 3/08* (2013.01)

(58) Field of Classification Search
CPC ..... H01Q 1/12; H01Q 1/1264; H01Q 3/08; H01Q 1/125; H01Q 3/00
See application file for complete search history.

(56) References Cited

U.S. PATENT DOCUMENTS 5,419,521 A * 5/1995 Matthews ..... F16M 11/10 248/179.1
7,095,376 B1 * 8/2006 Timothy ..... H01Q 1/125 343/705
2008/0258988 A1 * 10/2008 Son ..... H01Q 19/10 343/765
2009/0061761 A1 3/2009 Yang et al.
2010/0201589 A1 8/2010 Hallberg
(Continued)

FOREIGN PATENT DOCUMENTS

CN 201126853 Y 10/2008
CN 101494318 A 7/2009
(Continued)

OTHER PUBLICATIONS

Chinese Office Action dated May 22, 2020 issued in corresponding Chinese Application No. 201680087759.5 (with English translation).

(Continued)

*Primary Examiner* — Hoang V Nguyen
(74) *Attorney, Agent, or Firm* — Harness, Dickey & Pierce, P.L.C.

(57) ABSTRACT

An antenna with a radiation emitter/receiver, a base and a mount system capable of rotating the radiation emitter/receiver in relation to the base around at least three axes, where a controller may ensure that the emitter/receiver is directed in a first direction in relation to the base while portions of the mount system rotate so as to prevent bearings of the mount system to deteriorate.

15 Claims, 2 Drawing Sheets

(56) References Cited

U.S. PATENT DOCUMENTS

| | | | | |
|---|---|---|---|---|
| 2011/0068989 | A1* | 3/2011 | Bousquet | H01Q 3/02 343/761 |
| 2015/0059500 | A1* | 3/2015 | Conrad | H01Q 3/08 74/89.14 |
| 2016/0126626 | A1 | 5/2016 | Sakai et al. | |

FOREIGN PATENT DOCUMENTS

| | | | |
|---|---|---|---|
| CN | 201332139 | Y | 10/2009 |
| CN | 105229855 | A | 1/2016 |
| EP | 1246296 | B1 | 3/2005 |
| TW | 200913513 | A | 3/2009 |

OTHER PUBLICATIONS

International Search Report PCT/ISA/210 for International Application No. PCT/EP2016/064298 dated Mar. 8, 2017.
Written Opinion of the International Searching Authority PCT/ISA/237 for International Application No. PCT/EP2016/064298 dated Mar. 8, 2017.

* cited by examiner

ANTENNA AND A METHOD OF OPERATING IT

CROSS-REFERENCE TO RELATED APPLICATIONS

This application is a national phase under 35 U.S.C. § 371 of PCT International Application No. PCT/EP2016/064298 which has an International filing date of Jun. 21, 2016, the entire contents of each of which are hereby incorporated by reference.

The present invention relates to an antenna with a mount system comprising at least three axes and in particular to an antenna where the mount system moves even when the antenna direction is fixed in relation to the mount.

It has been found that in antennas having mount systems where the radiation emitting/receiving element is mounted rotatable around one or more axes in relation to a mount, the bearings facilitating rotation around the axes may be worn in particular circumstances where the radiation receiving/emitting element is directed in a predetermined direction in relation to the mount for extended periods of time. In this situation e.g. balls in ball bearings may locally deform (create cavities or dents) ball bearing elements rendering the ball bearings unsuitable for rotation, as the rotation thereafter will be uneven. Usually, such worn ball bearings must be replaced.

Antennas of this type may be used e.g. on structures such as oilrigs or means of transport of different types, such as ships or airplanes. Even though such means of transport usually move in relation to the target data source/receiver—typically a satellite, especially large ships hardly roll or pitch, so that the deck thereof seems as stable as solid ground.

Antennas of this type usually have a three-axis mounting system where the antenna disc, which is usually used for collimating/concentrating radiation, may be rotated around three axes in relation to an antenna mount or the means of transport to which the antenna is mounted. Even though any relative direction from the mount or the means of transport may be obtained using only rotation around two axes, a problem is seen with horizontal or vertical directions. This problem is called the "gimbal lock" and simply means that if only two axes are provided, the rotation around the axes must be infinitely fast in order to track an element positioned directly horizontally or vertically in relation to the antenna. Therefore, usually three axes are provided. Sometimes even more axes are provided.

The invention relates to a manner of avoiding such uneven wear.

In a first aspect, the invention relates to an antenna comprising:

- a radiation emitting/receiving element configured to emit radiation along a first direction and/or receive radiation from the first direction,
- a base,
- a mount system, the radiation emitting/receiving element and the base connected to the mount system, where the mount system comprises at least a first and a second mount part,
- a first drive configured to rotate the first mount part in relation to the base around a first axis,
- a second drive configured to rotate the second mount part in relation to the first mount part around a second axis,
- a third drive configured to rotate the radiation emitting/receiving element in relation to the second mount part around a third axis,

- a controller configured to control the first, second and third drives to:
  - maintain a predetermined relative direction between the base and the first direction while operating at least one of the drives to rotate at least one of:
    - the first mount part at least 2 degrees around the first axis in relation to the base,
    - the second mount part at least 2 degrees around the second axis in relation to the first mount part, and
    - the radiation emitting/receiving element at least 2 degrees around the third axis in relation to the second mount part.

In this respect, an antenna is an element configured to emit and/or receive radiation, such as radiowave radiation. A typical antenna of this type is configured to emit a collimated beam of radiation toward a target or receiver, such as a satellite or another antenna and/or receive radiation from a transmitter, such as a satellite or other antenna, and focus this radiation on to a receiver of the antenna.

The radiation emitting/receiving element may comprise a radiation emitter and/or radiation detector as well as a directing element, such as a parabolic disc, as is known in the art.

The direction of the radiation received/emitted may be defined by the directing element, such as a symmetry axis thereof, the boresight thereof and/or relative positions of the directing element and a radiation emitter/receiver.

The first direction thus is that in which radiation may be emitted and/or from which radiation may be received.

The antenna comprises a base. This base may be an element via which the remainder fo the antenna may be fastened to a structure, such as a vessel, a house, a vehicle, an airplane or the like. Thus, the radiation emitting/receiving element may be movable in relation to the base and this structure.

The mount system interconnects the base and the radiation emitting/receiving element. The mount element comprises at least a first and a second mount part. It is seen that the mount parts are rotatable in relation to each other as well as the radiation emitting/receiving element as well as the base.

Also, drives are provided for facilitating this rotation. Activating a drive means rotating one of the elements around the pertaining axis in relation to another of the elements.

The mount parts generally need only extend from one axis to the next and only to form a structure enabling the rotation around the axes. Thus, these mount parts may have any extent and any shape, be made of any material and used for any other purpose. Usually, the mount parts are rigid, so that a desired relation exists between the two axes to which the part belong, and so that any rotation provided between two parts is transferred to other portions of the parts and thus to other bearings in order to transfer the rotation to the antenna, in relation to the base.

The mount parts may additionally be used for supporting e.g. the drive(s) configured to rotate the particular part in relation to another part or the antenna/base. Furthermore, controllers, sensors, positional sensors, torque sensors, direction sensors (is an axis horizontal, for example), or the like.

The drives may be embodied in any desired manner. The function thereof is to rotate one element in relation to another element around an axis. This functionality may be obtained using any type of actuator, such as a linear actuator, such as an actuator operated electrically or with hydraulics, or a motor, such as a stepper motor or a brush-less motor.

Two or more drives may be embodied as a single motor/actuator, such as by using clutches, gears or the like for providing the torques/forces for effectuating the rotation around the different axes.

Rotation around an axis may be obtained in any manner, such as using a bearing interconnecting the two elements rotatable in relation to each other around the axis. This bearing may be of any type, such as a ball bearing.

The first drive is configured to rotate the first mount part in relation to the base around the first axis, and the second drive configured to rotate the second mount part in relation to the first mount part around the second axis. Thus, naturally, both the first and the second drives also may rotate the second mount part in relation to the base. This rotation may now be around any or both of the two axes.

The third drive is configured to rotate the radiation emitting/receiving element in relation to the second mount part around the third axis then makes it possible to rotate the antenna in relation to the base around any of at least three axes.

Naturally, more axes may be used. One mount part may, for example, have therein two parts, one rotatable in relation to the other around yet another axis, so that the antenna may be rotated in relation to the base around four axes.

The antenna comprises a controller configured to control the first, second and third drives. In this context, the controller may be an ASIC, an FPGA, a DSP, a chip, software programmable and/or hardwired. The controller may be monolithic or formed by a plurality of elements in communication with each other.

This aspect of the invention relates to, in the above context, control the drives to maintain a predetermined relative direction between the base and the first direction while operating at least one of the drives to relatively rotate the pertaining two portions (first mount part, second mount part, base or antenna) at least 2 degrees around the pertaining axis.

The first direction may be any direction in relation to e.g. a predetermined direction or axis of the base.

The relative direction may be any predetermined angle or angles (usually determined in each of one, two or more dimensions) relating to the base. In effect, if the base is rotated, the first direction is rotated in the same manner to maintain the predetermined relative direction.

Thus, while maintaining the first direction between the base and the radiation emitting/receiving element, rotation still takes place in the mount system around at least one axis.

Naturally, the radiation emitting/receiving element need not be absolutely fixed in relation to the base. The radiation emitting/receiving element may be tracking a source, such as a satellite and may thus perform minute directional corrections, such as within 1 degree or even within 0.5 degree, around the desired direction—that toward the satellite. Thus, in one situation, the controller is configured to maintain the predetermined relative direction within 1 degree.

In one situation, the movement of 2 degrees or more may be seen within a period of time where, during the same period of time, the radiation emitting/receiving element may rotate 1 degree or less in relation to the base. Thus, the movement seen between the first/second mount parts and the radiation emitting/receiving element is larger than that required to direct the radiation emitting/receiving element toward the desired direction.

In one situation, the controller is configured to, while maintaining the predetermined relative direction between the base and the first direction, rotate at least two of:

- the first mount part at least 2 degrees around the first axis in relation to the base,
- the second mount part at least 2 degrees around the second axis in relation to the first mount part, and
- the radiation emitting/receiving element at least 2 degrees around the third axis in relation to the second mount part.

Rotation around a single axis may be possible, if the first direction is along one of the axes. Thus, rotation around that axis may be possible while maintaining the direction of the antenna.

Usually, however, rotating around one axis would alter the direction of the antenna, but this may be counter-acted by rotating around also another axis. Which axes may be rotated and how the rotations should be coordinated to maintain the antenna in the desired direction is simple to the skilled person.

Naturally, it may be desired that the controller is configured to, while maintaining the predetermined relative direction between the base and the first direction, rotate all of:

- the first mount part at least 2 degrees around the first axis in relation to the base,
- the second mount part at least 2 degrees around the second axis in relation to the first mount part, and
- the radiation emitting/receiving element at least 2 degrees around the third axis in relation to the second mount part.

In one situation, the controller is configured to rotate the at least 2 degrees over a period of time exceeding 2 seconds. It is noted that the rotation need not be performed swiftly. What may be mainly desired is that e.g. a bearing is not fixed in the same position for too long. Thus, a small rotation over a long time may suffice. Thus, the rotation around any of the axes of the at least 2 degrees may take place over at least 5 seconds, 1 minute, 10 minutes, 1 hour, 10 hours, 1 day, 2 days, a week, a month or the like. On the other hand, it may be desired that the rotation takes place over no more than 1 year, such as no more than ½ year, such as no more than 1 month, such as no more than 2 days, such as no more than 1 day, such as no more than 10 hours, such as no more than 1 hour.

It is noted that the rotation of at least 2 degrees may be a rotation of at least 5 degrees, such as at least 10 degrees, such as at least 20 degrees, such as at least 45 degrees.

Naturally, some of or all of the axes may be parallel, but it is preferred that at least two of the axes are at an angle to each other. In one situation, the mount parts and the radiation emitting/receiving element may be rotated so that the axes are pair-wise perpendicular to each other. In one example, if one axis is vertical, two other axes are horizontal and perpendicular to each other.

The rotation around one or each axis, may take place, for each axis, between two outer rotational positions. The rotation may be periodical, cyclical or random/stochastic but within the outer rotational positions.

Thus, the controller may be configured to cyclically rotate the at least two of the drives to rotate at least two of:

- the first mount part at least 2 degrees around the first axis in relation to the base,
- the second mount part at least 2 degrees around the second axis in relation to the first mount part, and
- the radiation emitting/receiving element at least 2 degrees around the third axis in relation to the second mount part, within extreme angular positions positioned, around the respective axis, more than 2 degrees apart.

Thus, the rotation may take place for as long as the antenna is maintained in the first direction.

In one situation, the first and second axes are perpendicular to each other. In that or another situation, the second and third axes are perpendicular to each other. However, any angle may be provided between the first/second and second/third axes which, preferably, are not parallel.

Another aspect of the invention relates to a method of operating an antenna, such as an antenna according to the first aspect of the invention, comprising a base, a radiation emitting/receiving element receiving radiation from and/or emitting radiation toward a first direction, and a mount system connecting the radiation emitting/receiving element to the mount via at least a first and a second mount parts and enabling the radiation emitting/receiving element to be rotated in relation to the mount around three or more axes, the method comprising maintaining the radiation emitting/receiving element directed, in relation to the mount, in a predetermined direction while rotating a first mount part at least 2 degrees in relation to the base, a second mount part at least 2 degrees in relation to the emitting/receiving element and/or the first mount part at least 2 degrees in relation to the second mount part.

Naturally, the structural elements may be as those described above.

Also this aspect relates to the rotation of one or more of the mount parts the antenna and the base in relation to another thereof, while the antenna is maintained in the first direction in relation to the base. Again, this would normally be obtained by keeping the mount system fixed, but this aspect of the invention relates to nevertheless rotate portions of the mount system.

In one situation, the maintaining step comprises maintaining the radiation emitting/receiving element directed, in relation to the mount, in the predetermined direction while rotating at least two of: the first mount part at least 2 degrees in relation to the base, the second mount part at least 2 degrees in relation to the emitting/receiving element and the first mount part at least 2 degrees in relation to the second mount part.

In another situation, the maintaining step comprises maintaining the radiation emitting/receiving element directed, in relation to the mount, in the predetermined direction while rotating the first mount part at least 2 degrees in relation to the base, the second mount part at least 2 degrees in relation to the emitting/receiving element and the first mount part at least 2 degrees in relation to the second mount part.

As mentioned above, the maintaining step may comprise maintaining the radiation emitting/receiving element directed, in relation to the mount, in the predetermined direction within 1 degree. This may be in connection with a tracking of a transmitter, such as a satellite, where the antenna may be moved slightly in order to ensure that it is directed as well as possible toward the source—in the predetermined direction. Actually, when the source is a satellite, it is desired to maintain the antenna directed toward the antenna within 0.5 degrees.

In one situation, as is also described above, the maintaining step preferably comprises performing the rotation as a cyclical rotation within, for the or each axis, extreme angular or rotational positions—such as cyclically rotating the first mount part in relation to the base and the second mount part in relation to the emitting/receiving element within extreme angular positions positioned, around the respective axis, more than 2 degrees apart.

A third object of the invention relates to a method of operating an antenna mounted on to a structure tilting with respect to a vertical axis and with an amplitude of no more than 3 degrees, the antenna comprising a radiation emitting/receiving element receiving radiation from and/or emitting radiation toward a predetermined direction, and a mount system connecting the radiation emitting/receiving element to the structure via at least a first and a second mount parts and enabling the radiation emitting/receiving element to be rotated in relation to the structure around three or more axes, the method comprising rotating:

- the first mount part at least 5 degrees around a first axis in relation to the structure,
- the second mount part at least 5 degrees around a second axis in relation to the first mount part, and
- the radiation emitting/receiving element at least 5 degrees around a third axis in relation to the second mount part.

Thus, the antenna may be according to the first aspect of the invention, apart from the larger rotation and it no longer being desired to always maintain a predetermined relation between the base and the radiation emitting/receiving element. Then, the above embodiments and features may be relevant also in the third aspect of the invention. The base of the antenna according to the first invention may be added or replaced by the present structure.

In the present context, the structure may be a building positioned on the ground and thus stationary in relation to the earth and a vertical axis. Alternatively, the structure may be a semi-fixed installation, such as an oilrig usually fixed in relation to the earth but which may be moved, and which may be moved slightly in relation to the earth as it stands on large pillars which are not infinitely rigid. Further alternatively, the structure may be a large vessel floating on water which, due to its size tilts only slightly in relation to a vertical axis. It is noted that a vessel may change its heading, but this is not a tilting in relation to vertical.

In this respect, the structure may be configured to tilt no more than 2 degrees, such as no more than 1 degree, such as no more than ½ degree in relation to a vertical axis.

Tilting may be a periodic or substantially periodic movement.

The period of the tilting may be 5 seconds or more, such as 10 seconds or more, such as 20 seconds or more. The tilting frequency of a rigid structure, such as a building, may be rather high, whereas for a large vessel, it may be rather low.

A usual type of pedestal is one having at least three axes, where the receiving/emitting element, such as a parabolic element, is fastened to the third axis, where the third axis may be horizontal and/or where the second mount part may be rotated so that the third axis is horizontal.

In this aspect of the invention, the rotations in the pedestal or mount system are larger than the amplitude of the tilting of the structure. Again, this is to avoid the above problem.

Also, in order to e.g. track a satellite, rotation is normally required only around two axes, when the structure tilts only slightly. If a prior art pedestal, however, is moved to a position where the above gimball lock is close, the axis, which has not been used, will then be operated. However, then one of the other two, used until now, axes is locked. Then, in prior art pedestals, only two axes are operated at the time. According to this aspect of the invention, rotation takes place around at least 3 axes.

Preferably, the rotating step comprises, while:

- the first mount part rotates at least 5 degrees around the first axis in relation to the structure,
- the second mount part rotates at least 5 degrees around the second axis in relation to the first mount part, and the radiation emitting/receiving element rotates at least 5 degrees around the third axis in relation to the second mount part, directing the radiation emitting/receiving element toward a predetermined direction being more than 5 degrees away from a horizontal direction and a vertical direction.

Naturally, the predetermined direction may be more than 6 degrees, such as more than 7 degrees, such as more than 10 degrees, such as more than 15 degrees from the horizontal and the vertical direction.

In the most widely used pedestals, the gimball lock is seen at vertical or horizontal directions.

It is noted that the present aspect relates also to the situation where the desired direction may be toward a satellite which moves in relation to the ground—a non-geostationary satellite. Thus, the direction need not be fixed in relation to the structure. The predetermined relative direction may be a direction toward a radiation source/receiver, which is at a distance from the structure, such as a satellite.

In one situation, the rotating step comprises, while:

the first mount part rotates at least 5 degrees around the first axis in relation to the structure, the second mount part rotates at least 5 degrees around the second axis in relation to the first mount part, and the radiation emitting/receiving element rotates at least 5 degrees around the third axis in relation to the second mount part, altering the predetermined direction from a first direction to a second direction, the first and second directions being at least 5 degrees from a horizontal and a vertical direction, and a smallest angle between the first and second directions being at least 5 degrees.

As mentioned above, the directions may be more than 6, 7, 10 or 15 degrees from horizontal and vertical.

Usually, a satellite moves within the same plane, so that the first and second positions may be positions in a predetermined plane. Actually, the predetermined direction may be toward points or directions sequentially along a path taken by a satellite and/or points on a circle or ellipse surrounding the earth.

The first and second directions thus may be defined as the extreme positions where radiation may be emitted/received to/from a target, such as a satellite. The angle between the first and second directions thus may be at least 10 degrees, such as at least 20 degrees, such as at least 30 degrees, such as at least 40 degrees, such as at least 50 degrees, such as at least 60 degrees, such as at least 70 degrees, such as at least 90 degrees, such as at least 120 degrees, such as at least 150 degrees, such as at least 160 degrees.

Naturally, each of or all of the rotations may be 6 degrees or more, such as 7 degrees or more, such as 8 degrees or more, such as 10 degrees or more, such as 12 degrees or more, such as 15 degrees or more, such as 20 degrees or more, such as 25 degrees or more, such as 30 degrees or more, such as 40 degrees or more, such as 45 degrees or more.

This rotation may be from a first rotational position to a second rotational position around the axis.

Preferably, the altering step comprises:

the first mount part rotating at least 5 degrees around the first axis in relation to the structure, the second mount part rotating at least 5 degrees around the second axis in relation to the first mount part, and the radiation emitting/receiving element rotating at least 5 degrees around the third axis in relation to the second mount part, during a period of time where the amplitude is no more than 3 degrees.

Thus, during the period of time where the tilting is 3 degrees or less, the movement in the mount system still is larger. This period of time may be on the order of 1 minute, 2 minutes, 5 minutes, 10 minutes, 15 minutes, 30 minutes, 1 hour, 2 hours, 3 hours, 5 hours, 10 hours, 15 hours, 20 hours, 1 day, 2 days or the like.

Naturally, the above considerations, embodiments and examples also apply to this aspect of the invention.

In the following, preferred embodiments will be described with reference to the drawings, wherein.

Figure 1:
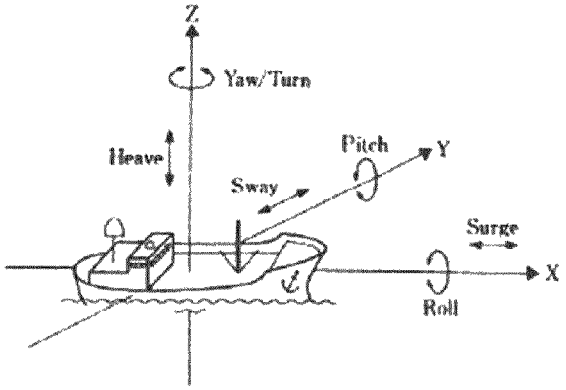
FIG. 1 illustrates the movement of a ship at sea.

In FIG. 1, the typical movements of a ship at sea are illustrated. In the following, a ship is used for illustrating the principle of the invention, even though the exact same solution may be useful also for antennas mounted on vehicles, airplanes or the like.

In general, the angular movement of a ship is a yaw, which alters the ships overall heading, a roll, which is a rotation around the longitudinal axis of the ship, and a pitch, which is a rotation around an axis perpendicular to the longitudinal axis and parallel to the deck of the ship.

To counteract such movements, the antenna is able to compensate for these movements of the base and keep the emitting/receiving element pointing in a fixed direction, such as toward a satellite or the like.

In this context, the actual antenna may be based on any principle. Usually, the antennas for this application are directed and often highly directed and thus comprise a disc, usually a parabolic disc, which is configured to collimate radiation output from the antenna and/or to focus radiation received on to a receiver. Often, the present set-ups are used for communicating with satellites.

The collimating/focusing disc may be replaced by an antenna array which to a certain degree is also able to direct/detect radiation.

As explained above, an antenna mounted to the ship needs only rotation around two (non-parallel) axes in order to direct the antenna toward any object around the ship, such as a satellite, but due to the "gimball lock" problem, rotation around at least three axes is desired.

Figure 2:
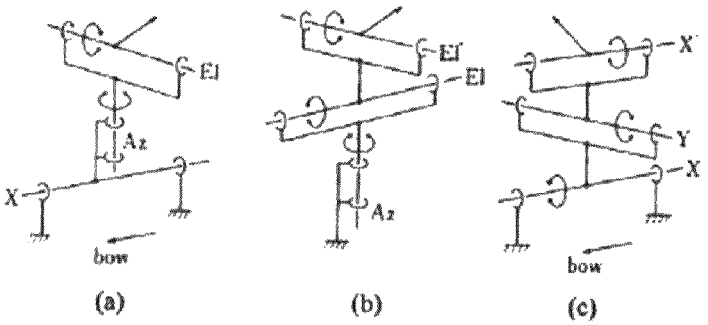
FIG. 2 illustrates a number of 3-axis set-ups.

Mount systems with three axis rotation are obtained in a number of manners. In FIG. 2, three types of three-axis set-ups (a), (b), and (c) are illustrated. In FIG. 2, the axes are illustrated but not the antenna, the base at which the mount systems are fastened to the e.g. ship, the elements rotated around the axes and the drives causing the rotation.

Figure 3:
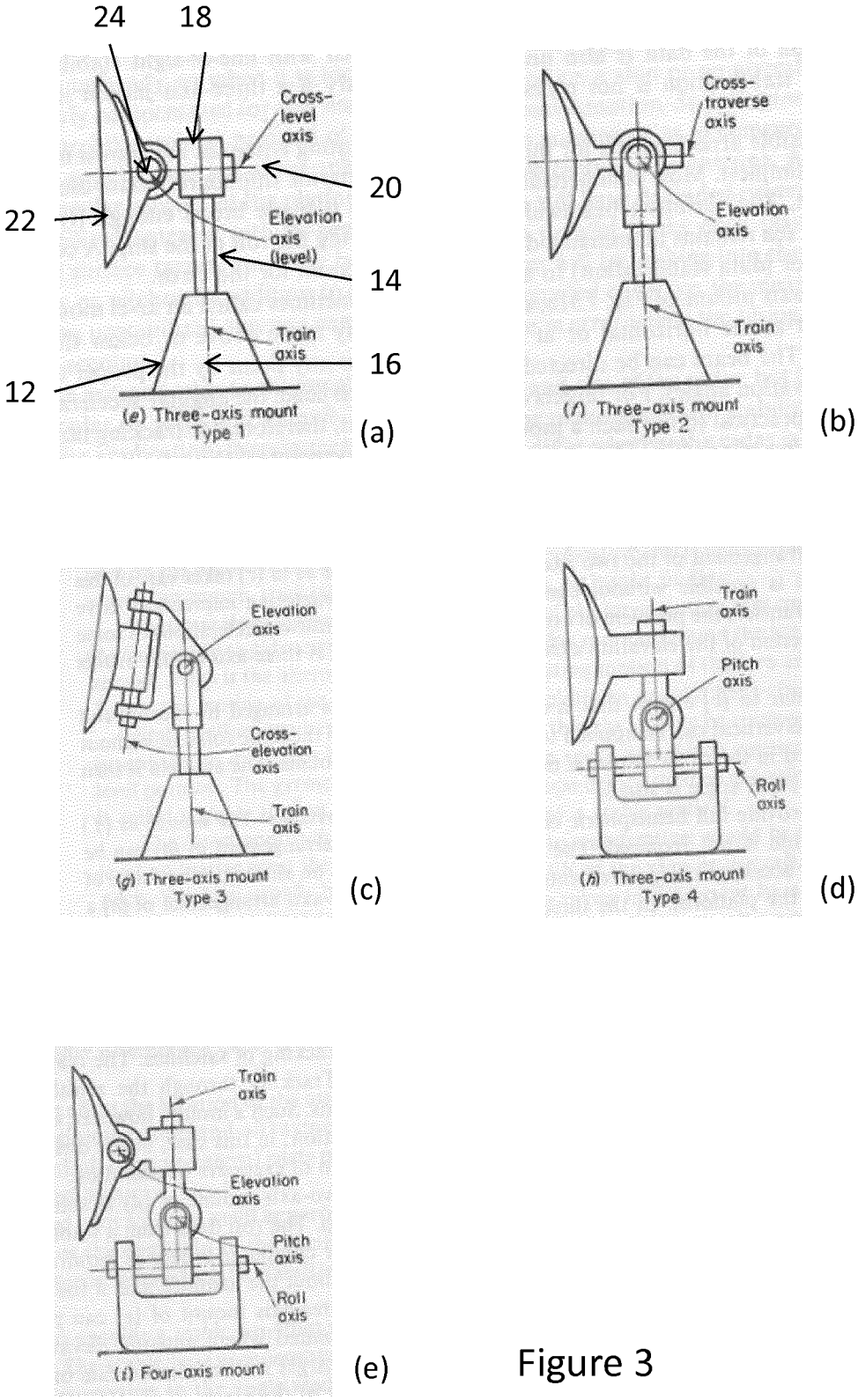
FIG. 3 illustrates 3-axis and 4-axis setups.

In FIG. 3, further set-ups are illustrated where set-ups (a), (b), (c), and (d) are three-axis set-ups. Naturally, also set-ups with more axes are known. In FIG. 3 (e) an example of a four-axis set-up is seen.

In general, rotation around an axis may be performed using an actuator, such as a linear actuator, which may be based on electrics or hydraulics, a motor, such as a stepper motor, an electrical motor, a brush-less motor, or the like.

Usually, the set-ups or mount systems have individual elements rotatable, relative to each other, around each axis. As an example, in FIG. 3 (a), an upright 14 is rotatable around an axis 16 in relation to a base 12 fastened to e.g. a ship. Another mount element 18 is rotatable around an axis 20 around another axis 20. The antenna (represented by its disc) 22 is rotatable around a third axis 24 in relation to the mount element 18.

Thus, in total, the antenna 22 is rotatable around three axes 16, 20, 24, in relation to the base 12. In the set-up illustrated, the axis 16 is vertical and the axis 20 is horizontal, if the base/vessel is stable.

The axis 16 is perpendicular to the axis 20 which again is perpendicular to the axis 24. These relative angles are defined by the mount elements 14 and 18 and may be selected as any angle between the pairs of axes. In some embodiments, the axis 20 may be directed 65 degrees in relation to the axis 16.

Several use cases are seen in antennas of this type.

If the antenna is fixed to a small vessel at sea, the vessel and thus the base will experience the movements illustrated in FIG. 1, whereby tracking of a satellite (geostationary or not) is usually performed by rotation around all three axes.

If the antenna is instead fixed to a very large vessel or a stationary object, such as a ground station or a building, the tracking of a geostationary satellite may be quite simple as the satellite may, at least for extended periods of time, be at the same angle from the base. Thus, no rotation around the axes need take place. This then brings about the above problem with the bearings. In this situation, the invention relates to the rotation of the bearings none the less.

In another use scenario, the antenna may be fixed to a large vessel or stationary object while tracking a non-geostationary satellite. In this situation, the satellite will travel along a well-defined path in relation to the vessel/object/base 12. This case will be described further below.

Thus, in the two last use scenarios, as only two axes are required in order to direct the antenna 22 toward the satellite, one degree of freedom is available and may be used for allowing rotation around one or two of the axes while still directing the antenna 22 to the satellite.

This rotation may both lubricate the bearings but may also prevent deformation of the bearings, which is often seen when bearings are stationary at the same rotational position—with load—for extended periods in time.

Thus, the rotation may be slow or fast, periodic or stochastic, large or small, as long as the rotation moves e.g. a ball in a ball bearing more than a few degrees.

The rotation amplitude around an axis preferably is at least 2 degrees and/or preferably takes place over more than 2 minutes, such as over more than an hour.

The rotation may be a rotation in one direction around the axis or may be reciprocal. Thus the rotation may be performed over an extended period of time, where rotation takes place between two extreme angular positions around the axis. The rotation within these angular positions may be periodical or stochastic.

The rotation may be quantified as an angular speed, such as one degree over 1 minute or more, such as 30 minutes or more, if desired.

In many situations, the rotation takes place about at least 2 of the axes in order to both allow rotation around the axes and maintain the direction of the disc/antenna toward the antenna.

In the last use scenario, two axes will usually be used for tracking the satellite. However, one axis may remain stationary and thus experience the bearing problem.

In the set-up seen in FIG. 3(*a*), the element 18 is normally rotated (around axis 20) so as to keep the axis 24 horizontal. This has the advantage that the rotational (around the axis 20) relationship between the antenna 22 and the satellite is always the same, which is an advantage when polarized radiation is to be received/transmitted.

Furthermore, with this limitation, the driving of the drives is simpler, as there is only a single solution to the equations defining the rotation of the drives.

It is noted that this is the situation even when the satellite is not geostationary and/or where the antenna moves slowly in relation to the satellite and/or the earth.

Thus, it is seen that when this antenna is positioned on a large vessel, an oilrig or a stationary object, there will be no or substantially no rotation around the axis 20, whereby the bearings in that respect have the above problem.

In order to avoid this problem, rotation is now desired around also the axis 20. Naturally, this will rotate the disc around the axis or direction toward the satellite, but this may be compensated for by allowing a receiver/transmitter of the actual antenna 22 be rotatable in relation to the disc or at least in relation to the element 18 and around a symmetry axis of the disc.

The invention claimed is:

1. An antenna, comprising:

a radiation emitting/receiving element configured to emit radiation along a first direction and/or receive radiation from the first direction, a base, a mount system, the radiation emitting/receiving element and the base connected to the mount system, where the mount system comprises at least a first mount part and a second mount part, a first drive configured to rotate the first mount part in relation to the base around a first axis, a second drive configured to rotate the second mount part in relation to the first mount part around a second axis, a third drive configured to rotate the radiation emitting/receiving element in relation to the second mount part around a third axis, and a controller configured to control the first, second and third drives, wherein the controller is configured to:

maintain a predetermined relative direction between the base and the first direction while operating at least one of the drives to rotate at least two of:

the first mount part at least 2 degrees around the first axis in relation to the base, the second mount part at least 2 degrees around the second axis in relation to the first mount part, and the radiation emitting/receiving element at least 2 degrees around the third axis in relation to the second mount part.

2. An antenna according to claim 1, wherein the controller is configured to, while maintaining the predetermined relative direction between the base and the first direction, rotate all of:

the first mount part at least 2 degrees around the first axis in relation to the base, the second mount part at least 2 degrees around the second axis in relation to the first mount part, and the radiation emitting/receiving element at least 2 degrees around the third axis in relation to the second mount part.

3. An antenna according to claim 1, wherein the controller is configured to rotate the at least 2 degrees over a period of time exceeding 2 seconds.

4. An antenna according to claim 1, wherein the controller is configured to rotate the at least 2 degrees over a period of time being 2 days or less.

5. An antenna according to claim 1, wherein the controller is configured to maintain the predetermined relative direction within 1 degree.

6. An antenna according claim 1, wherein the controller is configured to cyclically rotate the at least two of the drives, within extreme angular positions positioned, around the respective axis, more than 2 degrees apart.

7. A method of operating an antenna comprising a base, a radiation emitting/receiving element receiving radiation from and/or emitting radiation toward a first direction, and a mount system connecting the radiation emitting/receiving element to the base via at least a first mount part and a second mount part and enabling the radiation emitting/receiving element to be rotated in relation to the base around three or more axes, the method comprising:

maintaining the radiation emitting/receiving element directed, in relation to the base, in a predetermined direction while rotating at least two of: the first mount part at least 2 degrees in relation to the base, the second mount part at least 2 degrees in relation to the emitting/receiving element, and the first mount part of at least 2 degrees in relation to the second mount part.

8. A method according to claim 7, wherein the maintaining step comprises maintaining the radiation emitting/receiving element directed, in relation to the base, in the predetermined direction while rotating the first mount part at least 2 degrees in relation to the base, the second mount part at least 2 degrees in relation to the emitting/receiving element and the first mount part at least 2 degrees in relation to the second mount part.

9. A method according to claim 7, wherein the maintaining step comprises maintaining the radiation emitting/receiving element directed, in relation to the base, in the predetermined direction within 1 degree.

10. A method according to claim 7, wherein the maintaining step comprises cyclically rotating the first mount part in relation to the base and the second mount part in relation to the radiation emitting/receiving element within extreme angular positions positioned, around the respective axis, more than 2 degrees apart.

11. A method of operating an antenna mounted on to a structure tilting with respect to a vertical axis and the tilting having an amplitude of no more than 3 degrees, the antenna comprising a radiation emitting/receiving element receiving radiation from and/or emitting radiation toward a predetermined direction, and a mount system connecting the radiation emitting/receiving element to the structure via at least a first mount part and a second mount part and enabling the radiation emitting/receiving element to be rotated in relation to the structure around three or more axes, the method comprising:

rotating the first mount part at least 5 degrees around a first axis in relation to the structure, rotating second mount part at least 5 degrees around a second axis in relation to the first mount part, and rotating the radiation emitting/receiving element at least 5 degrees around a third axis in relation to the second mount part, wherein angles of rotation, of the rotating around the first axis, the second axis, and the third axis, are each larger than the amplitude of the tilting of the structure with respect to the vertical axis.

12. A method according to claim 11, wherein the rotating step comprises, while:

the first mount part rotates at least 5 degrees around the first axis in relation to the structure, the second mount part rotates at least 5 degrees around the second axis in relation to the first mount part, and the radiation emitting/receiving element rotates at least 5 degrees around the third axis in relation to the second mount part, directing the radiation emitting/receiving element toward a predetermined direction being more than 5 degrees away from a horizontal direction and a vertical direction.

13. A method according to claim 11, wherein the rotating step comprises, while:

the first mount part rotates at least 5 degrees around the first axis in relation to the structure, the second mount part rotates at least 5 degrees around the second axis in relation to the first mount part, and the radiation emitting/receiving element rotates at least 5 degrees around the third axis in relation to the second mount part, altering the predetermined direction from a first direction to a second direction, the first and second directions being at least 5 degrees from a horizontal and a vertical direction, and a smallest angle between the first and second directions being at least 5 degrees.

14. A method according to claim 11, wherein the altering step comprises:

the first mount part rotates at least 5 degrees around the first axis in relation to the structure, the second mount part rotates at least 5 degrees around the second axis in relation to the first mount part, and the radiation emitting/receiving element rotates at least 5 degrees around the third axis in relation to the second mount part, during a period of time where the amplitude is no more than 3 degrees.

15. An antenna, comprising:

a radiation emitting/receiving element configured to emit radiation along a first direction and/or receive radiation from the first direction, a base, a mount system, the radiation emitting/receiving element and the base connected to the mount system, where the mount system comprises at least a first and a second mount part, a first drive configured to rotate the first mount part in relation to the base around a first axis, a second drive configured to rotate the second mount part in relation to the first mount part around a second axis, a third drive configured to rotate the radiation emitting/receiving element in relation to the second mount part around a third axis, and a controller configured to control the first, second and third drives, wherein the controller is configured to, while maintaining a predetermined relative direction between the base and the first direction, operate the first drive, the second drive, and the third drive to rotate all of the first mount part at least 2 degrees around the first axis in relation to the base, the second mount part at least 2 degrees around the second axis in relation to the first mount part, and the radiation emitting/receiving element at least 2 degrees around the third axis in relation to the second mount part.

* * * * *